US009731873B2

(12) United States Patent
Wei et al.

(10) Patent No.: US 9,731,873 B2
(45) Date of Patent: Aug. 15, 2017

(54) COVER DEVICE FOR COVERING A BUILT-IN VALVE MOUNTING CHANNEL PORT OF IBC AND CONTAINER

(71) Applicant: SHANGHAI HONGYAN RETURNABLE TRANSIT PACKAGINGS CO., LTD, Shanghai (CN)

(72) Inventors: Wenjing Wei, Shanghai (CN); Qingxin Liao, Shanghai (CN)

(73) Assignee: Shanghai Hongyan Returnable Transit Packagings Co., Ltd., Shanghai (CN)

( * ) Notice: Subject to any disclaimer, the term of this patent is extended or adjusted under 35 U.S.C. 154(b) by 0 days.

(21) Appl. No.: 14/425,508

(22) PCT Filed: Sep. 4, 2013

(86) PCT No.: PCT/CN2013/082931
§ 371 (c)(1),
(2) Date: Mar. 3, 2015

(87) PCT Pub. No.: WO2014/036941
PCT Pub. Date: Mar. 13, 2014

(65) Prior Publication Data

US 2015/0225137 A1 Aug. 13, 2015

(30) Foreign Application Priority Data

Sep. 4, 2012 (CN) ..... 2012 1 0324749

(51) Int. Cl.
*B65D 43/16* (2006.01)
*B65D 19/06* (2006.01)
(Continued)

(52) U.S. Cl.
CPC ..... *B65D 43/16* (2013.01); *B65D 19/06* (2013.01); *B65D 19/38* (2013.01); *B65D 43/22* (2013.01);
(Continued)

(58) Field of Classification Search
CPC ..... B65D 43/16; B65D 55/02; B65D 88/54; B65D 88/02; B65D 55/14; B65D 43/22;
(Continued)

(56) References Cited

U.S. PATENT DOCUMENTS 2,271,660 A 2/1942 Norbom
4,366,915 A * 1/1983 Seidler ..... A45C 11/24 206/1.5

(Continued)

FOREIGN PATENT DOCUMENTS

CN 201105852 8/2008
CN 201553333 8/2010

(Continued)

OTHER PUBLICATIONS

International Search Report for international application No. PCT/CN2013/082931, dated Dec. 5, 2013 (8 pages).

(Continued)

*Primary Examiner* — James N Smalley
(74) *Attorney, Agent, or Firm* — Hamre, Schumann, Mueller & Larson, P.C.

(57) ABSTRACT

The present invention discloses a cover device used to cover the built-in valve mounting channel port of IBC and a container. The IBC comprises a side plate, a base and a channel located in the base and used to receive the built-in valve. The cover device comprises a cover and structures or components used to detachably connect the cover to the side plate over the channel. The cover can be installed on the base at the position adjacent to the side plate, and can be rotated
(Continued)

around a rotational axis of the cover itself, so as to open or cover the channel port. The cover is further provided with a lock hole, and the base is provided with a locking slot, so that the cover can be locked to the base by a disposable lock. The cover device of the present invention has a simple structure and is easy to operate. Further, it can well achieve the effect of dust-proof and/or thief-evident.

12 Claims, 17 Drawing Sheets

(51) Int. Cl.

| | |
|---|---|
| ***B65D 19/38*** | (2006.01) |
| ***B65D 77/06*** | (2006.01) |
| ***B65D 43/22*** | (2006.01) |
| ***B65D 55/14*** | (2006.01) |
| ***B65D 88/02*** | (2006.01) |
| ***B65D 88/54*** | (2006.01) |
| ***B65D 55/02*** | (2006.01) |

(52) U.S. Cl.
CPC ..... *B65D 55/02* (2013.01); *B65D 55/14* (2013.01); *B65D 77/061* (2013.01); *B65D 88/02* (2013.01); *B65D 88/54* (2013.01); *B65D 2313/04* (2013.01); *B65D 2519/009* (2013.01); *B65D 2519/00288* (2013.01); *B65D 2519/00293* (2013.01); *B65D 2519/00333* (2013.01); *B65D 2519/00582* (2013.01); *B65D 2519/00646* (2013.01); *B65D 2519/00805* (2013.01); *B65D 2588/125* (2013.01)

(58) Field of Classification Search
CPC ..... B65D 19/06; B65D 77/061; B65D 19/38; B65D 2519/00646; B65D 2519/009; B65D 2519/00582; B65D 2588/125; B65D 2519/00805; B65D 2313/04
USPC .... 220/826, 831–835, 840, 712, 719, 254.3, 220/230, 214
See application file for complete search history.

(56) References Cited

U.S. PATENT DOCUMENTS

| | | | | |
|---|---|---|---|---|
| 4,711,372 | A * | 12/1987 | Gach | B65D 47/0885 206/807 |
| 4,809,875 | A * | 3/1989 | Takano | B65D 43/162 206/701 |
| 4,949,865 | A * | 8/1990 | Turner | B65D 47/0847 220/254.3 |
| 5,445,289 | A | 8/1995 | Owen | |
| 5,893,475 | A * | 4/1999 | May | B65D 55/06 215/252 |
| 6,533,122 | B1 | 3/2003 | Plunkett | |
| 2002/0130128 | A1* | 9/2002 | Berglund | B65D 43/167 220/230 |
| 2007/0227938 | A1 | 10/2007 | Higgins | |
| 2008/0105696 | A1* | 5/2008 | Dart | B65D 43/0212 220/711 |
| 2011/0255229 | A1* | 10/2011 | Murakata | H05K 5/0086 361/679.01 |

FOREIGN PATENT DOCUMENTS

| | | |
|---|---|---|
| CN | 202115803 | 1/2012 |
| CN | 102785829 | 11/2012 |
| CN | 202987819 | 6/2013 |
| EP | 0509228 | 10/1992 |
| EP | 1152955 | 3/2003 |
| FR | 2830000 | 3/2003 |
| GB | 2297740 | 8/1996 |
| KR | 2006-0040650 | 5/2006 |
| KR | 2010-0008131 | 1/2010 |
| WO | 9919220 | 4/1999 |

OTHER PUBLICATIONS

Extended European Search Report for application No. 13835298.4, dated Feb. 11, 2016 (9 pages).

* cited by examiner

COVER DEVICE FOR COVERING A BUILT-IN VALVE MOUNTING CHANNEL PORT OF IBC AND CONTAINER

FIELD

The present invention relates to containers, in particular to dust-proof and thief-evident for a built-in valve mounting channel port of IBC.

BACKGROUND

For the IBC in prior art, a cover is generally provided at the port of the valve mounting channel used to install a valve at the bottom of the container. The cover can achieve the effect of dust-proof to some extent. However, some of the known cover can not cover the port completely, resulting poor dust-proof. Further, after the cover at the channel port is flipped, the cover is not connected to any other elements, thus the operator needs to hold the cover while operating it, which is very inconvenient. After the installation of the valve, the operator needs to put the cover back to the channel port manually, which reduces the operation efficiency. Moreover, after the channel port is opened, it occupies extra space of the IBC. Thus, if a forklift is used, the cover is easy to be damaged.

In addition, covers in prior art used to cover the port of the valve mounting channel generally have no thief-evident feature since the cover can be opened directly. Some of the covers employ disposable plastic lids as their thief-evident features. Such plastic lid comprises three parts connected to each other through walls with unequal thicknesses, wherein the middle part is a tearable part, each of the other two parts at two sides has a snap snapping at the valve mounting channel port. The operator tears up the middle part of the plastic cover at first, and then disengages the snap from the valve mounting channel port at both sides when opening the cover, which is very inconvenient. Moreover, a general tool can be used to disengage the snap of the plastic lid at both sides. The middle part will not be damaged or torn, and the intact cover will be removed due to the plasticity of the plastic itself, resulting poor thief-evident effect. At the same time, the cover can not be reused, thereby increasing the cost. In addition, the fitting part located at the valve mounting channel port may be damaged while tearing the plastic lid.

SUMMARY

The object of the present invention is to provide a cover device used to cover a built-in valve mounting channel port of IBC, and the cover device is easy to operate and can well achieve the effect of dust-proof and/or thief-evident.

To achieve the above object, the present invention provides a cover device used to cover a built-in valve mounting channel port of IBC, said IBC comprises a side plate, a base and a channel located in said base and used to receive the built-in valve, characterized in that:

said cover device comprises a cover and structures or components used to detachably connect said cover to the side plate over said channel; and said cover can be installed on said base at the position adjacent to said side plate and can be rotated around a rotational axis of the cover itself, so as to open or cover said channel port.

In a preferred embodiment of the present invention, said cover is a plate member, comprising a fitting part and a cover body, wherein said rotational axis is located between said fitting part and said cover body, so that said cover body can be rotated around said rotational axis;

fitting pins used to assemble said cover to said base are provided at the left and right sides of the fitting part respectively; and a structure used to be detachably engaged with the side plate is provided on said cover body, and a mating structure corresponding to said structure on said cover body is provided at the side plate.

In the above preferred embodiment, preferably, said structure on the cover body detachably engaged with the side plate are locking slots located at the left and right sides respectively;

said mating structure on the side plate are grooves and ribs on both sides of said grooves respectively; and said locking slots can be engaged with said ribs under elastic deformation, so as to keep said cover on said side plate, and said locking slots can be disengaged from said ribs so as to disengage said cover from said side plate.

In the above preferred embodiment, preferably, said structure on said cover body detachably engaged with the side plate comprises a locking snap projecting integrally from said cover body surface;

said corresponding structure on said side plate is a snap hole on said side plate; and said locking snap can be snapped into said snap hole so as to keep said cover on said side plate, and said locking snap can be disengaged from said snap hole so that said cover is disengaged from said side plate.

In the above preferred embodiment, preferably, said structure on said cover body detachably engaged with the side plate is a metal piece;

said corresponding structure on said side plate is a magnet; and said metal piece and said magnet can be attracted to or separated from each other so as to respectively keep said cover on the side plate and disengage said cover from said side plate.

In the above preferred embodiment, preferably, a rotating part is provided between said fitting part and said cover body, wherein said fitting part, rotating part and said cover body are integrally formed; and the thickness of said rotating part is thinner than that of said fitting part and said cover body, so that when said cover body is flipped upward, said cover body is rotated around said rotating part.

In the above preferred embodiment, preferably, said fitting part is provided with hinge holes, and said cover body is provided with hinge pins, wherein said hinge holes and said hinge pins constitute hinges so that after said fitting part being assembled to said cover body, when said cover body is flipped upward, said cover body is rotated around said hinges.

The present invention further provides a cover device used to cover a built-in valve mounting channel port of IBC, said container comprises a side plate, a base and a channel located in said base and used to receive the built-in valve, characterized in that: said cover device comprises a cover and structures or components used to detachably connect said cover to said side plate over said channel;

said cover can be installed on said base at the position adjacent to said side plate, and can be rotated around the rotational axis of the cover itself, so as to open or cover said channel port; and said cover is further provided with a lock hole, and said base is provided with a locking slot, so that said cover can be locked to said base by a disposable lock. For the cover device according to embodiments described above, preferably, the cover body is further provided with a metal piece at the lower part thereof and said base is provided with a magnet, so that the metal piece and the magnet can be attracted to or disengaged from each other so as to keep said cover on said base or disengage said cover from said base.

The present invention also provides a intermediate bulk container (IBC), said container comprises a side plate, a base and a channel located in said base and used to receive the built-in valve, wherein said container further comprises said cover device according to embodiments described above.

The cover device of the present invention used to cover the built-in valve mounting channel port of IBC has a simple structure and is easy to operate. The shape of the cover device corresponds to the channel port of the channel used to receive the built-in valve, and therefore has a good dust-proof effect. Further, the cover device can be engaged with a disposable lock to achieve a good thief-evident effect. Besides, the cover device can be reused, thereby saving the cost.

BRIEF DESCRIPTION OF DRAWINGS

FIGS. 5*a*-5*b* are sectional views showing relative positions of components of the cover device according to the first embodiment of the present invention when the cover is closed, wherein FIG. 5*b* is a partial enlarged view of part A in FIG. 5*a;*

FIGS. 6*a*-6*b* are sectional views showing relative positions of components of the cover device according to the first embodiment of the present invention when the cover is opened, wherein FIG. 6*b* is a partial enlarged view of part B in FIG. 6*a;*

FIGS. 7*a*-7*c* illustrate one embodiment of a disposable lock that can be used for the cover device of the present invention, wherein FIG. 7*a* is a perspective view, FIG. 7*b* is a side view, and FIG. 7*c* is a front view;

FIGS. 14*a*-14*b* show relative positions of components of the cover device according to the second embodiment of the present invention when the cover 8 is closed, wherein FIG. 14*b* is a partially enlarged view of part C in FIG. 14*a;*

FIGS. 15*a*-15*b* show relative positions of components of the cover device according to the second embodiment of the present invention when the cover is opened, wherein FIG. 15*b* is a partially enlarged view of part D in FIG. 15*a;*

FIG. 18*b* is a partially enlarged view of part E in FIG. 18*a.*

DETAILED DESCRIPTION

Figure 1:
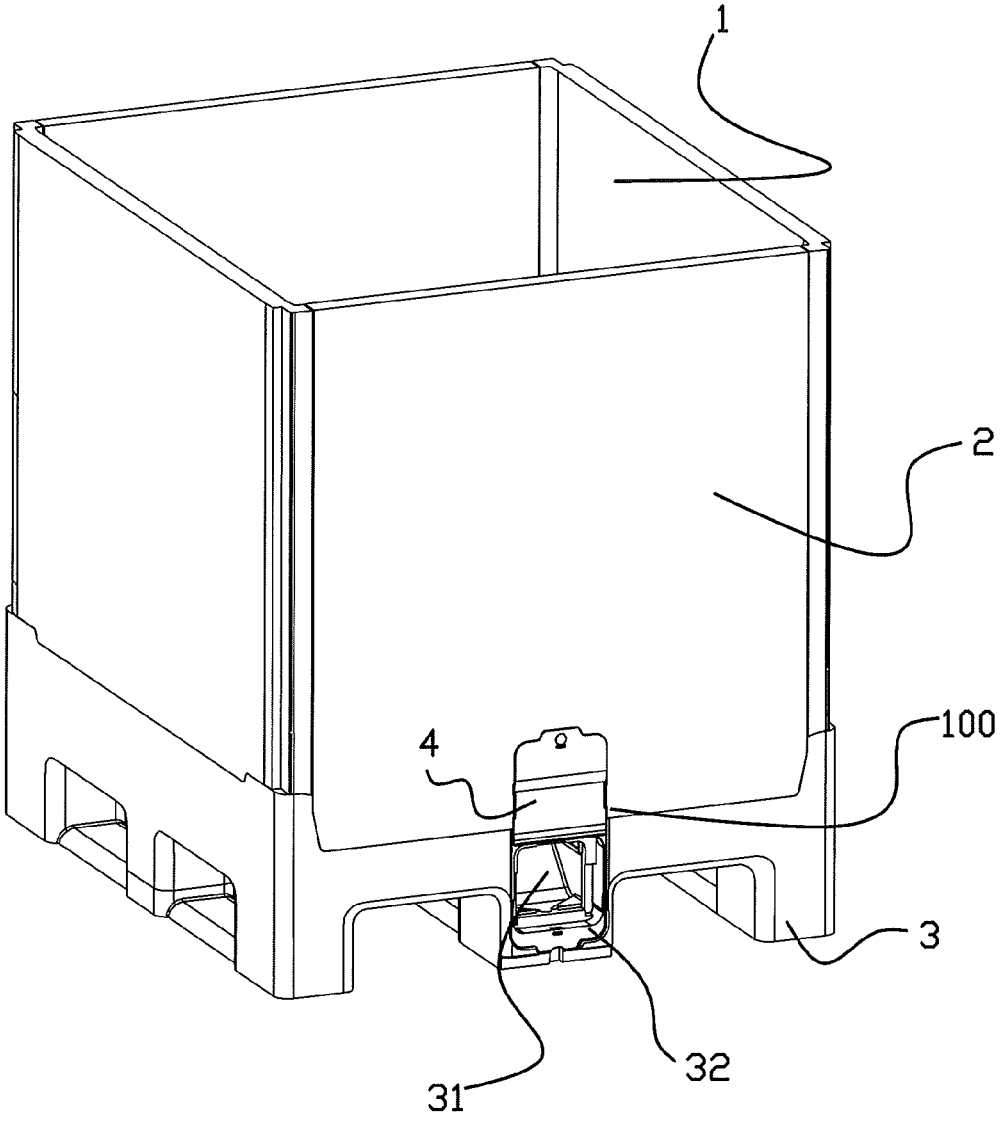
FIG. 1 shows a perspective view of an IBC provided with a cover device according to the present invention.

Hereinafter, preferred embodiments of the present invention will be described in detail with reference to the drawings, so that the purposes, features and advantages of the present invention will be more clearly understood. It should be understood that embodiments shown in the drawings are not to limit the scope of the invention, but merely to illustrate the true spirit of the technical solution of the present invention. Herein, same or similar components are denoted by same reference numerals.

Herein, Intermediate Bulk Container (IBC) is a packaging turnover container widely used in food, biochemical, pharmaceutical, chemical and other industries. Because IBC can be used repeatedly, they have distinct advantages in filling, storage and transportation. Compared with the barrels, IBC containers can save about 35% of the storage space, and the dimensions thereof conform to ISO standards. IBC is not only suitable for aseptic filling but also has compact structure, and is convenient to store large quantities of goods with safety and efficiency, thus they are widely used in transportation, package, storage for materials in the form of liquid, particles and flakes. Currently, there are three existing specifications, including 820L, 1000L, 1250L, for IBC which usually comprises a plastic liner, a filling port, a discharge valve, side plates, a base and a cover plate. Because those liquids or particulate matters stored in IBC are mostly pharmaceutical intermediates, beverage concentrates, food additives and even dangerous materials, etc., which are not only expensive but also relate to sanitation and safety, IBC should has the function of preventing unauthorized opening or discharge during use.

FIGS. 1-9 show the first embodiment of a cover device 100 for covering a built-in valve mounting channel port of IBC. FIG. 1 shows an IBC 1 provided with the cover device 100 of the present invention. As shown in FIG. 1, container 1 comprises a side plate 2, a base 3, a valve mounting channel 31 provided at the base 3 and used to receive the valve, a cover device 100 used to cover the port 32 of valve mounting channel Cover device 100 comprises a cover 4 and structures provided at container 1 and engaged with the cover 4, so that when the cover 4 is closed, the valve mounting channel port 32 can be completely covered, thereby preventing dust and other foreign matter from entering the valve mounting channel. When cover 4 is opened, the cover may be held on the side plate 2, so that the operator does not need to hold the cover while operating the valve. Also, when the cover is put down, it will automatically cover the mounting channel port 32, which will be further described hereinafter.

Figure 2:
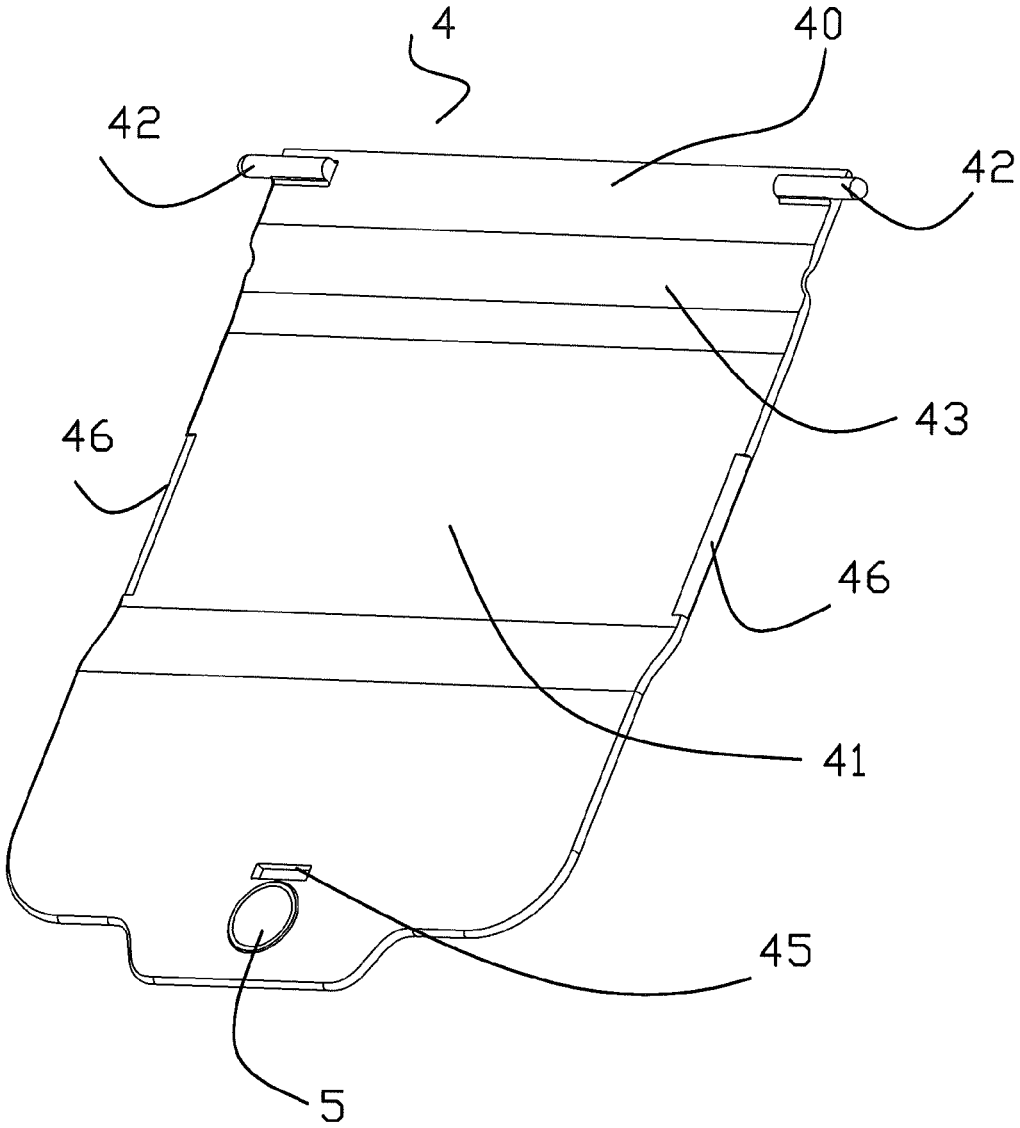
FIG. 2 shows a perspective structural view of the cover device according to the first embodiment of the present invention.

FIG. 2 shows a structural perspective view of the cover 4 of the cover device 100 according to the present invention. As shown in FIG. 2, the cover 4 is a plate member, including a fitting part and a cover body. The shape of the cover 4 can be designed according to the specific shape of the valve mounting channel port. Fitting part 40 of the cover 4 (i.e., the upper portion of the plate member) is provided integrally with fitting pins 42 used to assemble the cover 4 to the base 3 at its left and right sides, wherein fitting pins 42 can be circular pins, or pins of any other suitable shapes. The cover can be assembled to the base by snaps; pivots, screws and so on. A rotating part 43 is provided between the fitting part 40 of the cover 4 and cover body 41, so that the cover body 41 can be rotated around the rotating part 43. The thickness of the rotating part 43 is thinner than that of the fitting part 40 and that of the body 41, so that when the cover body 41 is flipped upward, the body 41 is rotated around rotating part 43.

Locking slots 46 are provided at left and right sides at the substantially intermediate position of the cover body 41 respectively, and are used to be engaged with ribs on the side plate 2 (described in detail hereinafter) respectively when the cover 4 is opened, so as to lock the cover 4 to the side plate 2.

A metal piece 5 is provided at the lower part of cover body 41 and may be molded integrally with cover body 41, thereby locking the cover when the cover 4 is closed due to magnetic attraction between the metal piece 5 and the magnet provided on base of the container. The metal piece 5 can be made of any metal attractable to magnet, such as iron, cobalt, nickel and other materials. Also, it can be still a magnet. Preferably, the metal piece is a magnet. Preferably, a locking hole 45 is provided at an appropriate place (in this embodiment, above metal piece 5) on the cover body 41. The locking hole 45 is used to be engaged with the disposable lock so as to lock the cover 4 to the container. When there is a need to open the cover 4, the disposable lock should be destroyed at first. Only in this way, will the cover be opened, thereby achieving thief-evident, which will be described in detail hereinafter.

Figure 3:
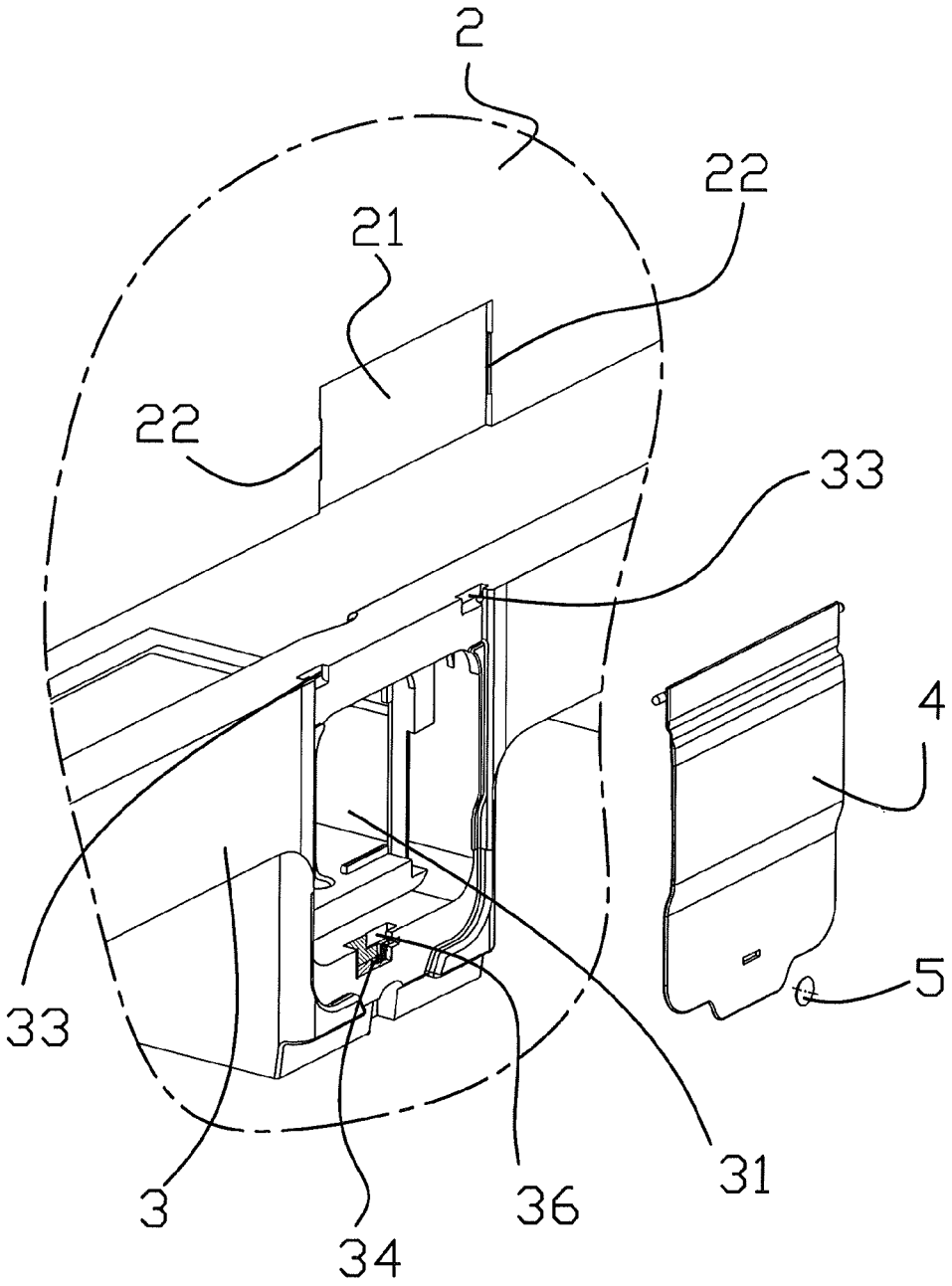
FIG. 3 shows an exploded perspective view of the container in FIG. 1, for clarity, here is shown only the parts associated with the cover device of the present invention.

FIG. 3 illustrates an exploded perspective view of the container in FIG. 1, for clarity, only the parts associated with the cover device of the present invention are shown here. As shown in FIG. 3, grooves 33 are provided at the upper edge of the base 3 of the container above the valve mounting channel 31 and contacting with side plate 2. Grooves 33 are used to receive fitting pins 42 of the cover 4, so as to assemble the cover 4 to the base 3. During assembly, at first, the side plate 2 is put down, and then the fitting pin 42 is inserted into groove 33. After the side plate is erected up, the side plate 2 limits the position of the fitting pins 42 and hides them, so that the cover can not escape from container 1. On the contrary, when there is a need to disassemble the cover 4, put down the side plate 2, then you can remove the cover.

A groove 34 (more clearly illustrated in FIG. 5*b*) used to receive the magnet 6 is provided at the base 3 under the valve mounting channel 31. The position of the groove 34 corresponds to that of the metal piece 5 of the installed cover 4, so that the magnet 6 and the metal pieces 5 can attract each other, thereby keeping the cover 4 covering the valve mounting channel port 31. Preferably, a locking groove 36 (more clearly shown in FIG. 9) is further provided at the base 3. Similarly, the position of the locking groove 36 corresponds to that of the locking hole 45 on the installed cover 4, so that a disposable lock 7 (shown in FIGS. 9*a*-9*c*) can pass though the locking hole 45, enter and snap in the locking groove 36, thereby locking the cover 4 to the container. When the cover 4 is needed to be opened, only the lock 7 is destroyed then will the cover be further opened, thereby achieving thief-evident.

Also as shown in FIG. 3, a pit 21 is provided at the side plate 2. The ribs 22 are provided at both sides of the pit 21. When the cover is opened and flipped upwardly, the locking slots 46 on cover 4 can be snapped into the ribs 22 respectively under the effect of elastic deformation, so as to keep the cover 4 on the side plate 2.

Figure 4:
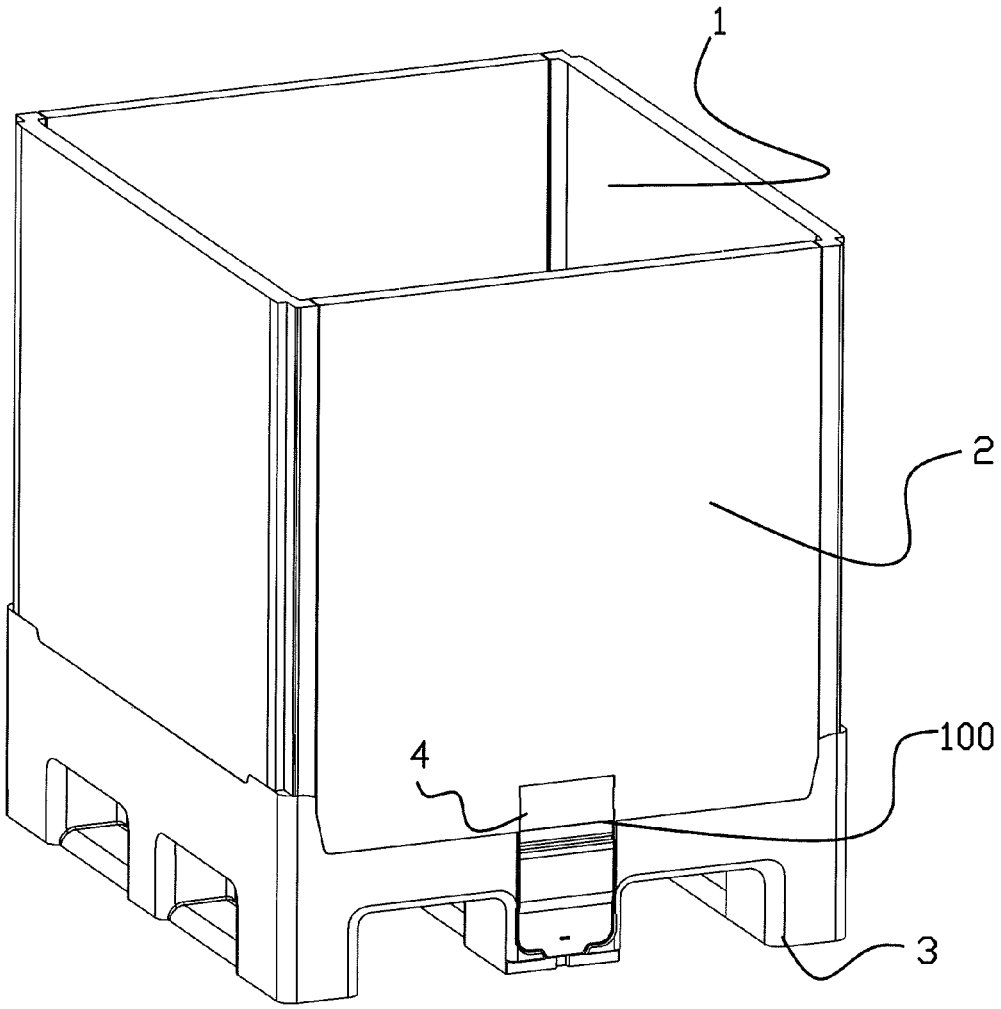
FIG. 4 is a perspective view of the container showing the cover according to the first embodiment of the present invention being closed.
Figure 5A:
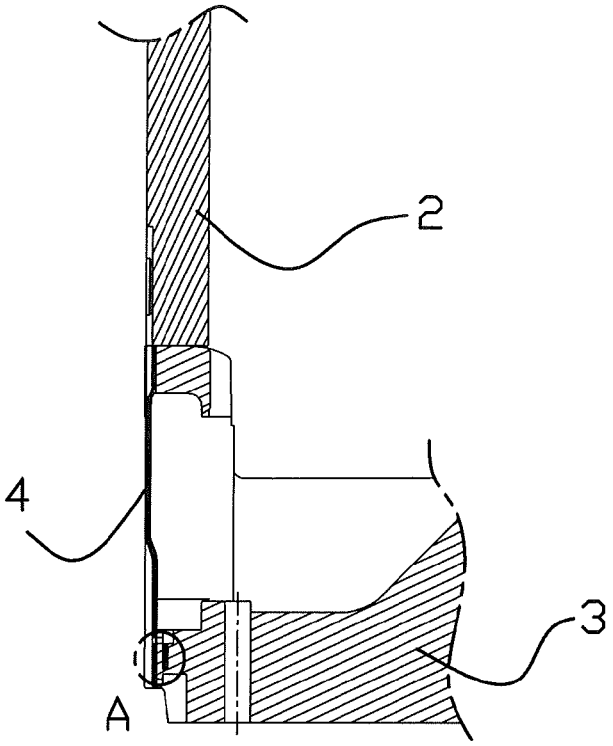
Figure 5B:
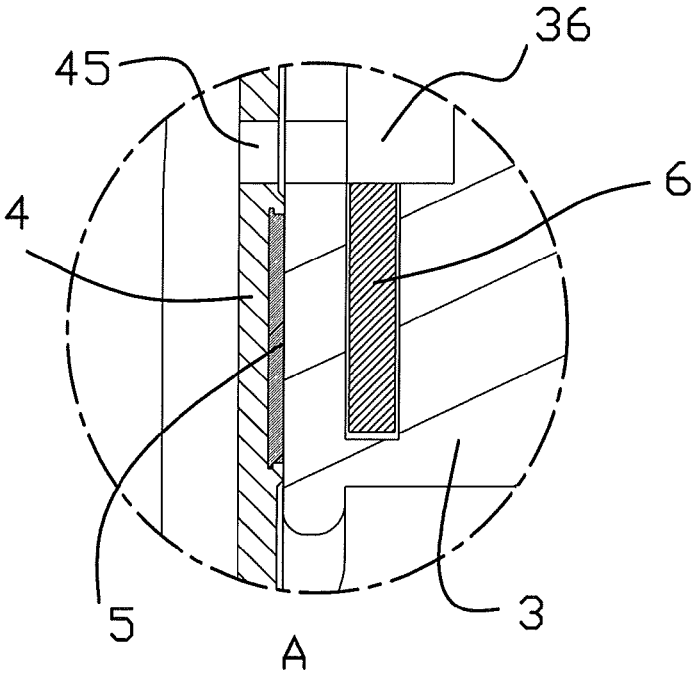

FIG. 4 is a perspective view of the container, in which the cover 4 is closed. FIGS. 5*a*-5*b* show relative positions of components of the cover device 100, wherein the cover 4 is closed. As shown in FIG. 5*b*, the cover 4 is in a closed state, and the locking hole 45 is aligned to the locking groove 36. The magnet 6 is received in groove 34. The center of metal piece 5 and the center of the magnet 6 are on substantially the same straight line, so that the metal piece 5 and the magnet 6 can effectively attract to each other, thus securely locking the cover 4.

Figure 6A:
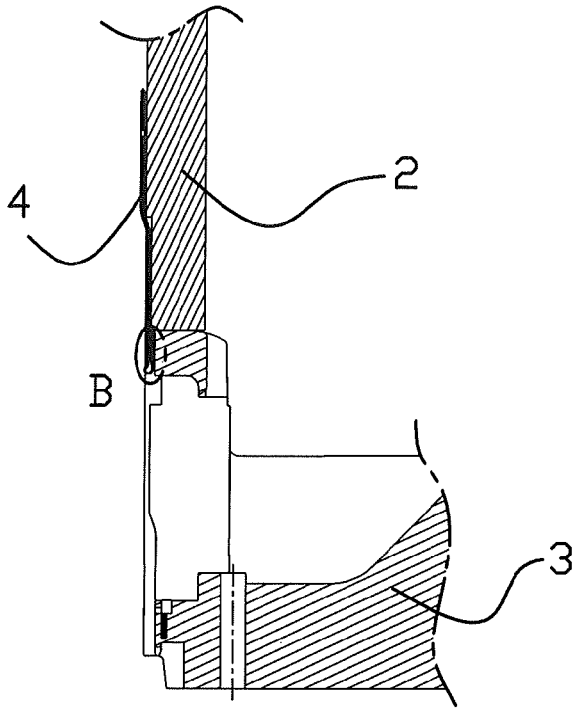
Figure 6B:
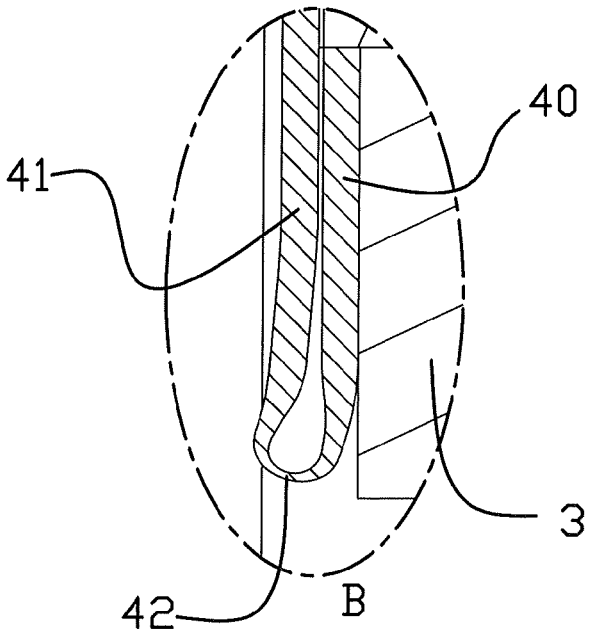

FIGS. 6*a*-6*b* show sectional views of the container, wherein the cover 4 of which is open, for clarity, only the structures associated with the present invention are shown here. As shown in FIGS. 6*a*-6*b*, after the cover 4 is opened, the cover body 41 can be rotated around the rotating part 42 and can be held on the side plate 2 through the engagement of the locking slots 46 on cover 4 with the ribs 22 on side plate 2.

When it is needed to put down the cover to cover the valve mounting channel port, just pull it out forcefully. The cover 4 will be separated from the side plate 2 due to the elastic deformation of ribs 22. After the separation of the slots 46 and ribs 22, the cover 4 will be flipped downward due to gravity and elasticity, then cover the valve mounting channel port 32 through the interaction (magnetic attraction) between the metal piece 5 and the magnet 6.

Alternatively, when side plate 2 falls down, the cover will be automatically disengaged from side plate 2 and flipped downward due to gravity and elasticity, then cover the valve mounting channel port 32 through the interaction (magnetic attraction) between the metal piece 5 and the magnet 6.

Figure 7A:
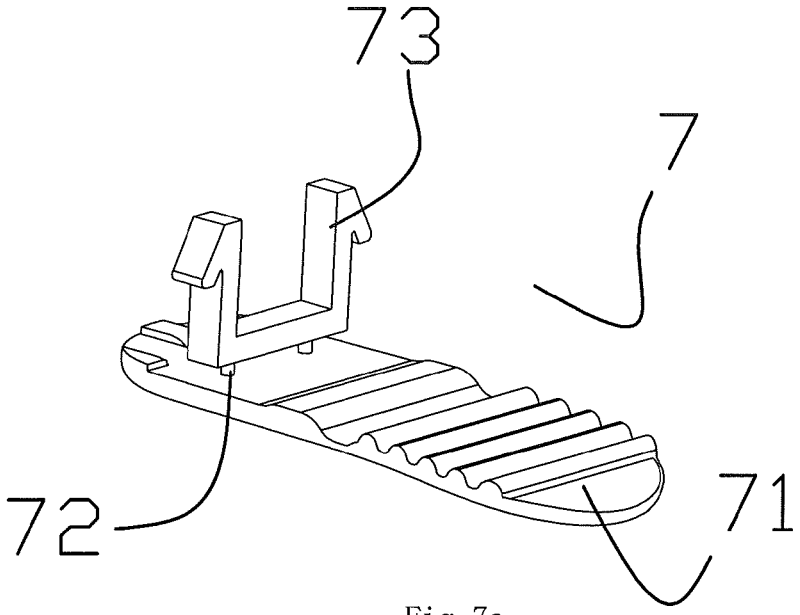
Figure 7B:
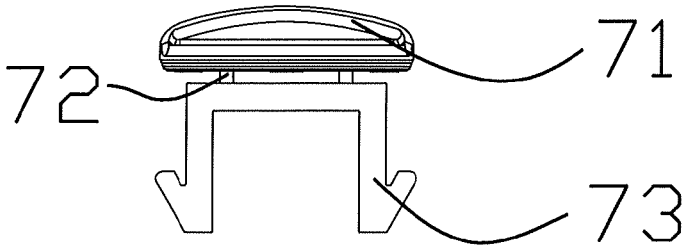
Figure 7C:
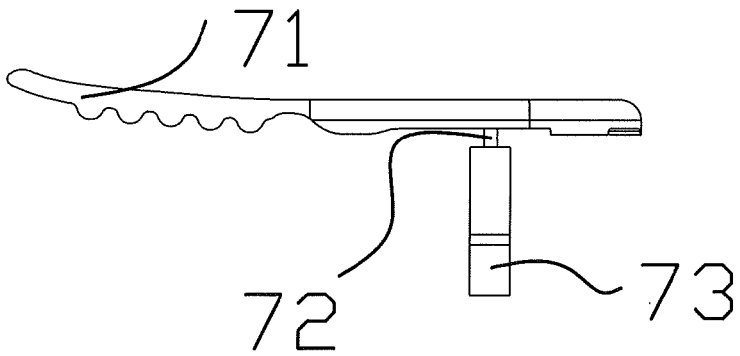

FIGS. 7*a*-7*c* show one embodiment of a disposable lock used in the cover device of the present invention. It should be understood that those skilled in the art may also use any other suitable disposable lock. As shown in FIGS. 7*a*-7*c*, lock 7 comprises a handle 71, a tear part 72 and an elastic snap 73. Preferably, the handle 71, the tear part 72 and the elastic snap 73 are formed as one piece. The handle 71 is a plate member and is connected to the elastic snap 73 through the tear part 72. The tear part 72 is a portion easy to be torn. In this embodiment, the tear part comprises two thin rods connecting the handle 71 to the elastic snap 73. When a force acts on the handle 71, i.e., when handle 71 is pulled along the direction perpendicular to the plane of the handle, the tear part 72 is torn, so that the handle 71 is disengaged from the elastic snap 73 so as to disengage the cover 4 from the base 3.

Figure 8:
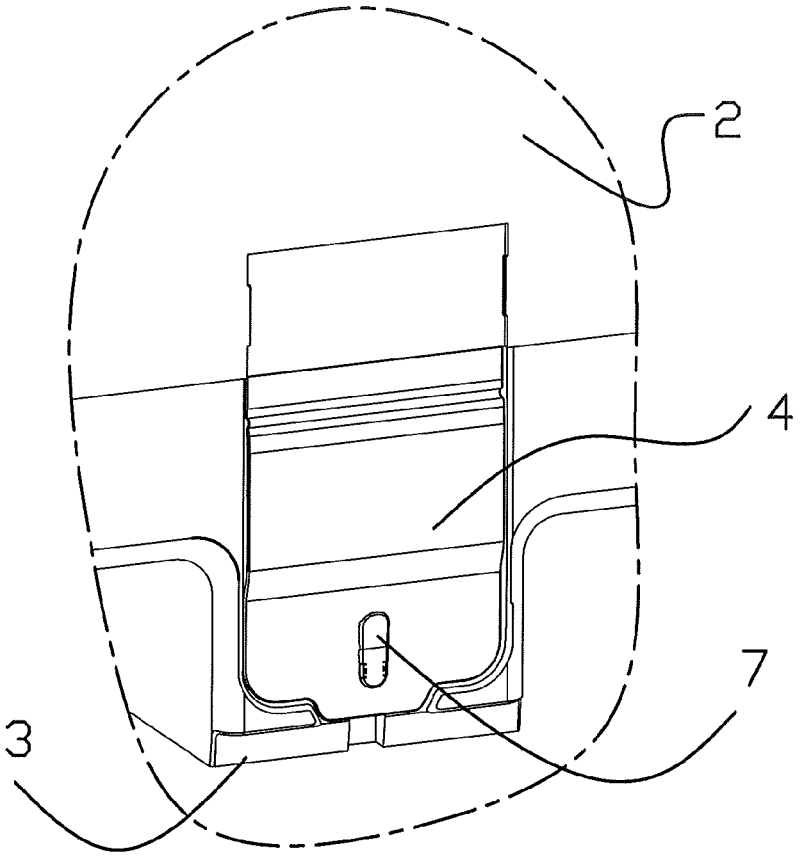
FIG. 8 illustrates a structural view of the cover device provided with the disposable lock shown in FIG. 7*a*-7*c;*
Figure 9:
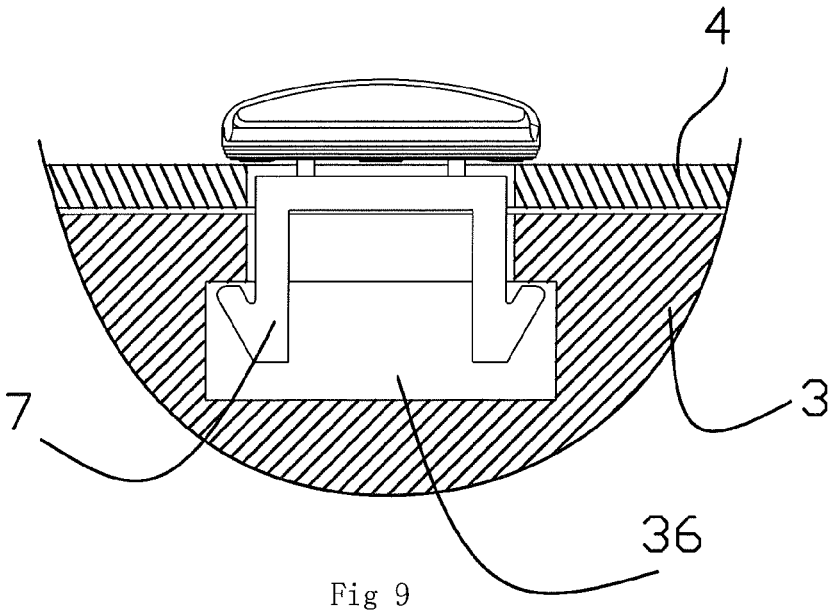
FIG. 9 illustrates a sectional view of the cover device provided with the disposable lock shown in FIG. 7*a*-7*c;*

FIGS. 8-9 show a schematic structural view of the cover device 100 provided with the disposable lock 7 shown in FIGS. 7*a*-7*c*. As shown in FIG. 9, when the lock 7 is pressed down, the snap 73 on the lock 7 will be snapped into the locking groove 36 on the base 3, thereby locking the cover 4 to the base 3. When you need to open the cover 4, at first pull the lock 7 forcefully, so that the tear part 72 on lock 7 is broken, thereby opening the door 4. Because the rupture of the tear part 72 of the disposable lock 7 is unrecoverable, and the torn lock remains in the locking groove 36 of the base 3, once a broken tear part of disposable lock 7 is found, it means that the goods in the container may have been opened without authorization during transportation, and the owner may therefore conduct further investigation to determine whether the goods in IBC has been opened without authorization, thereby achieving a thief-evident function. Preferably, security code can be printed on the disposable lock 7 to obtain improved thief-evident effect.

Figure 10:
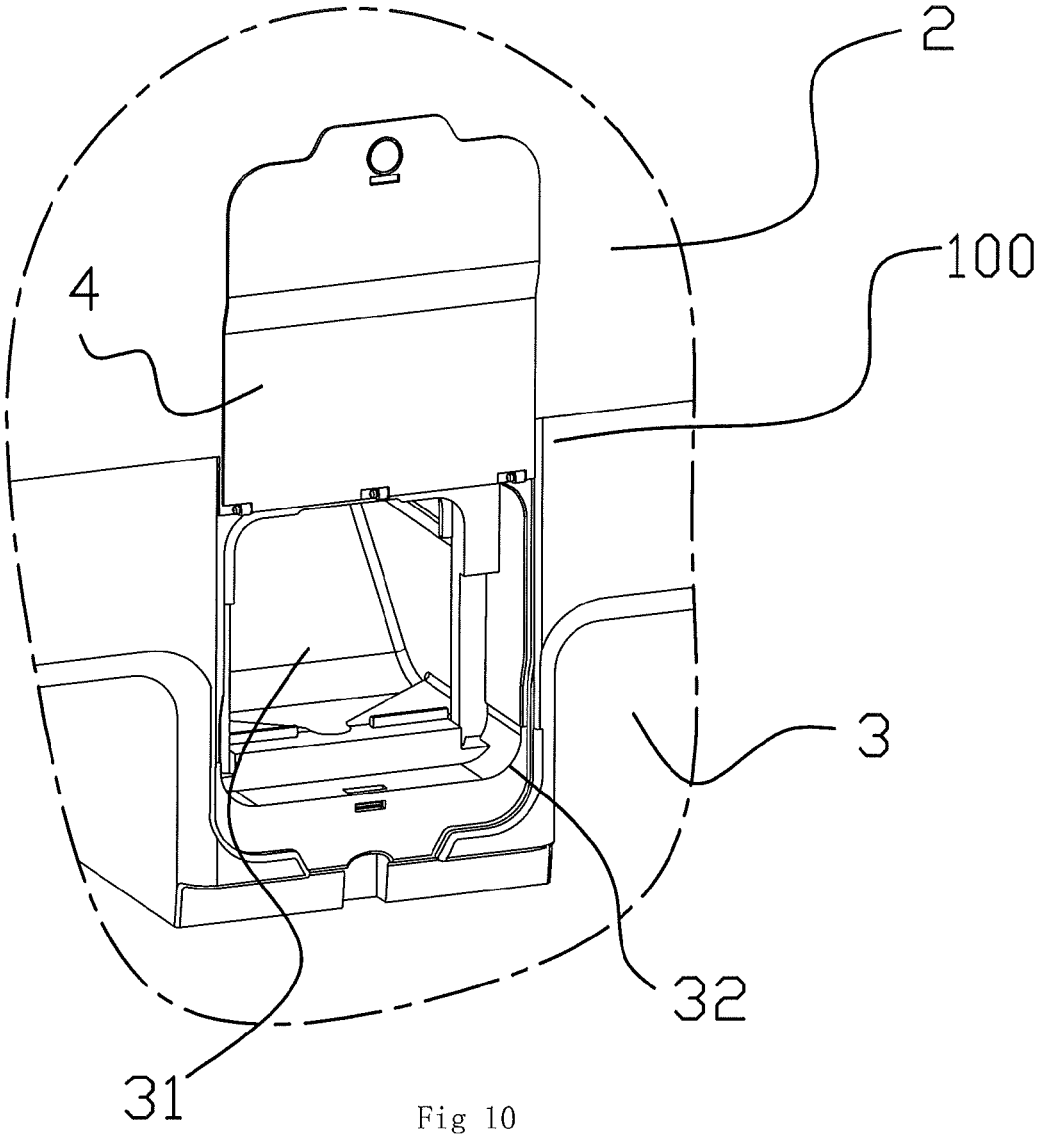
FIG. 10 illustrates a partial perspective view of an IBC provided with a cover device according to the second embodiment of the present invention.

FIGS. 10-15*b* shows the second embodiment of the cover device 100 used to cover a built-in valve mounting channel port of IBC. FIG. 10 shows a partially structural view of the IBC 1 provided with the cover device 100 of the present invention. As shown in FIG. 1, the container comprises a side plate 2, a base 3, a valve mounting channel 31 provided at the base 3 and used to receive the valve, and a cover device 100 used to cover the valve mounting channel port 32. Cover device 100 comprises a cover 4 and structures provided on the container 1 and engaged with the cover 4, so that when cover 4 is closed, the valve mounting channel port 32 can be completely covered so as to prevent dust and other foreign matter from entering the valve mounting channel. When the cover 4 is opened, the cover can be held on the side plate 2 so that the operator does not need to hold the cover while operating the valve. When the cover is put down, it will automatically cover the valve mounting channel port 32, which will be described in more detail hereinafter.

Figure 11:
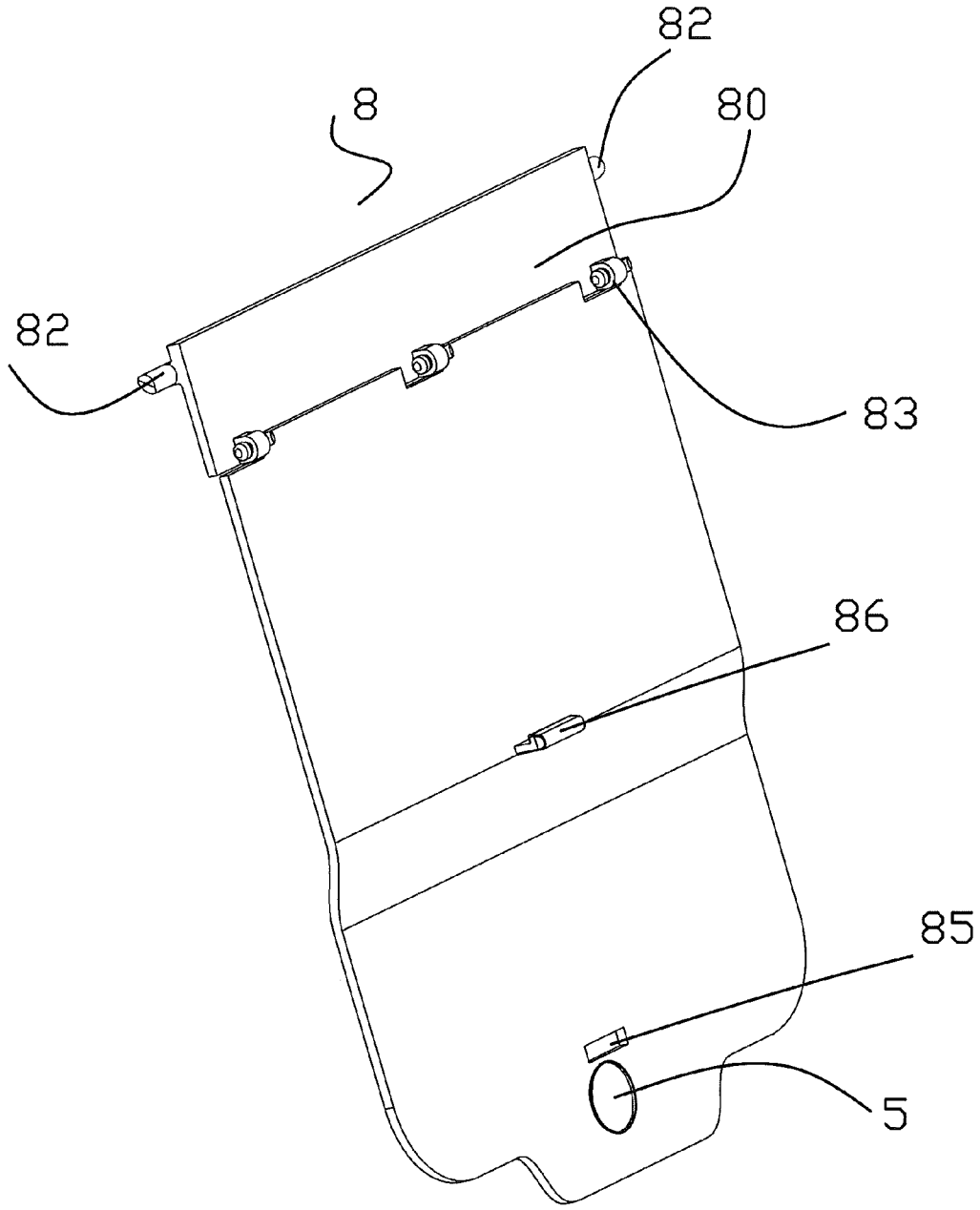
FIG. 11 illustrates a perspective structural view of the cover according to the second embodiment of the present invention.

FIG. 11 shows a perspective structural view of the cover 8 of the cover device 100 of the present invention. As shown in FIG. 11, the cover 8 is a plate member, the shape of which can be designed according to the specific shape of the valve mounting channel port. The cover 8 comprises a fitting part 80 and a body 81, wherein the fitting part 80 and the body 81 are connected with each other by a hinge 83 which is comprised of hinge holes located on the fitting part and hinge pins located on the body 81. After the fitting part 80 is assembled to the body 81, the body 81 is rotated around the hinge 83 (as a rotational axis) when the body 81 is flipped upward. The fitting part 80 is integrally provided with fitting pins 82 used to assemble the cover 8 to the base 3 at the left and right sides respectively. The fitting pins 82 may be circular pins, or pins of any other suitable shape.

A cover locking snap 86 projecting integrally from the surface of the cover body is provided at the middle of the cover body 81. The cover locking snap 86 will be engaged with a snap hole on side plate 2 so that the cover 8 is locked to side plate 2 after the cover is opened, which will be further described hereinafter.

A metal piece 5 is provided at the lower part of the cover body 81. The metal piece 5 may be molded integrally with the cover body 81 so as to lock the cover (when cover 8 is closed) due to the magnetic attraction between the metal piece 5 and the magnet provided on the base of the container. The metal piece 5 can be made of metals attractable to the magnet, such as iron, cobalt, nickel and other materials. Also, it can be a magnet. Preferably, the metal piece is a magnet. Preferably, a locking hole 85 is provided at an appropriate place (in this embodiment, above metal piece 5) on the cover body 81. The locking hole 85 is used to be engaged with the disposable lock so as to lock the cover 8 to the container. When there is a need to open the cover 8, the disposable lock should be destroyed at first. Only in this way, will the cover be opened, thereby achieving thief-evident, which will be described in detail hereinafter.

Figure 12:
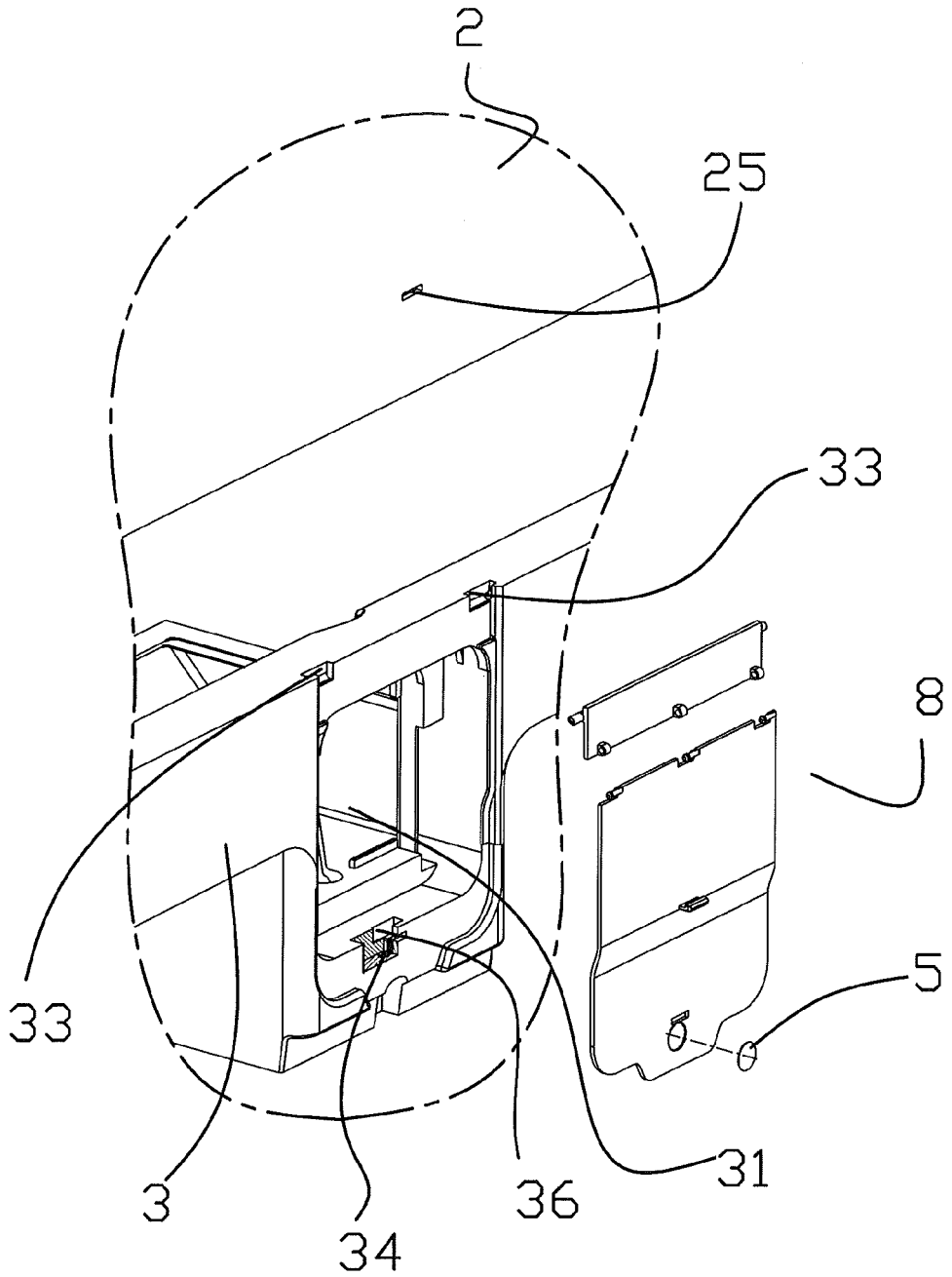
FIG. 12 shows an exploded perspective view of the container in FIG. 10, for clarity, here is shown only the parts associated with the cover device of the present invention.

FIG. 12 illustrates an exploded perspective view of the container in FIG. 10, for clarity, only the parts associated with the cover device of the present invention is shown here. As shown in FIG. 12, grooves 33 are provided at the upper edge of the base 3 of the container above the valve mounting channel 31 and contacting with side plate 2. Grooves 33 are used to receive fitting pins 82 of cover 8, so as to assemble the cover 8 to base 3. During assembly, at first, the fitting part 80 and the body 81 are assembled together, then the side plate 2 is put down, and the fitting pin 82 is inserted into the groove 33. After the side plate 2 is erected up, the side plate 2 limits the position of fitting pins 82, so that the cover could not escape from container 1, and the fitting part 80 could not rotate around the fitting pins 82. On the contrary, when there is a need to disassemble the cover 8, put down side plate 2, then you can remove the cover.

A groove 34 (more clearly illustrated in FIG. 14*b*) used to receive magnet 6 is provided at the base 3 under the valve mounting channel 31. The position of the groove 34 corresponds to that of the metal piece 5 of the installed cover 8, so that magnet 6 and metal pieces 5 can attract with each other, thereby keeping the cover 8 covering the valve mounting channel port 31. Preferably, a locking groove 36 (more clearly shown in FIG. 9) is further provided at the base 3. Similarly, the position of the locking groove 36 corresponds to that of the locking hole 85 on the installed cover 8, so that a disposable lock 7 (shown in FIGS. 9*a*-9*c*) can pass though the locking hole 45, enter and snap in locking groove 36, thereby locking the cover 8 to the container. When you need to open the cover 8, only the lock 7 is destroyed then will the cover be further opened, thereby achieving thief-evident.

Also as shown in FIG. 12, a snap hole 25 is provided at the side plate 2. When the cover 8 is opened and flipped upward, the locking snap 86 on the cover 8 can snap into the snap hole 25 in order to keep the cover 8 on the side plate 2.

Figure 13:
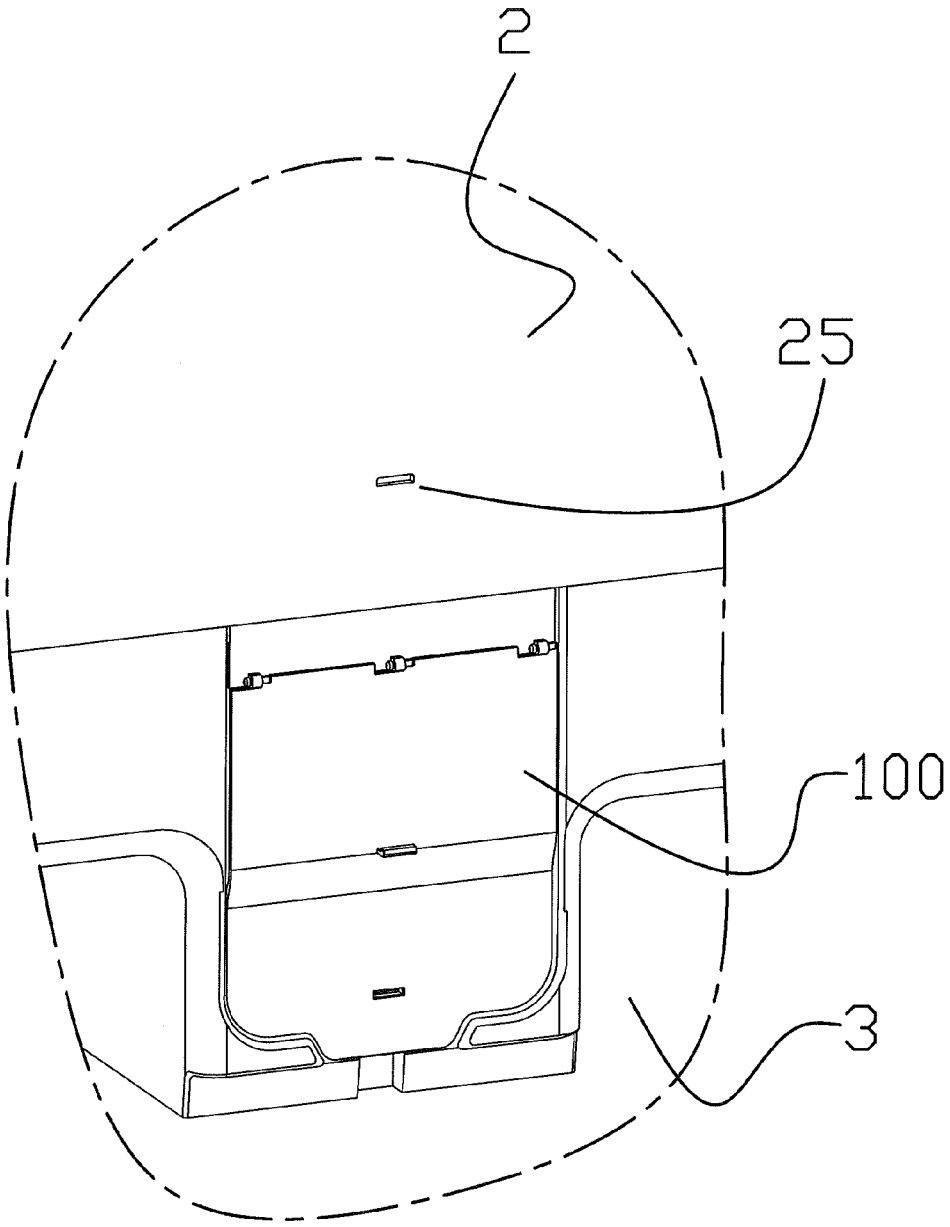
FIG. 13 is a partial perspective view of the container showing the cover according to the second embodiment of the present invention being closed.
Figure 14A:
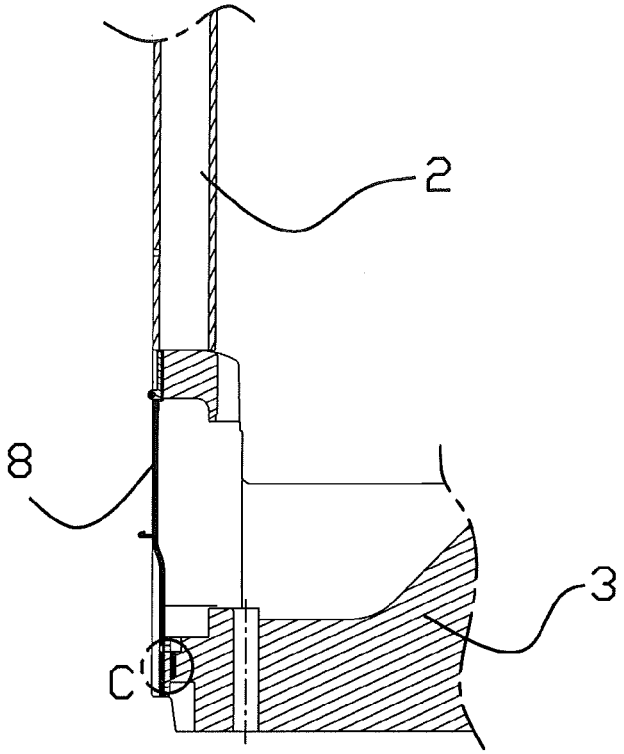
Figure 14B:
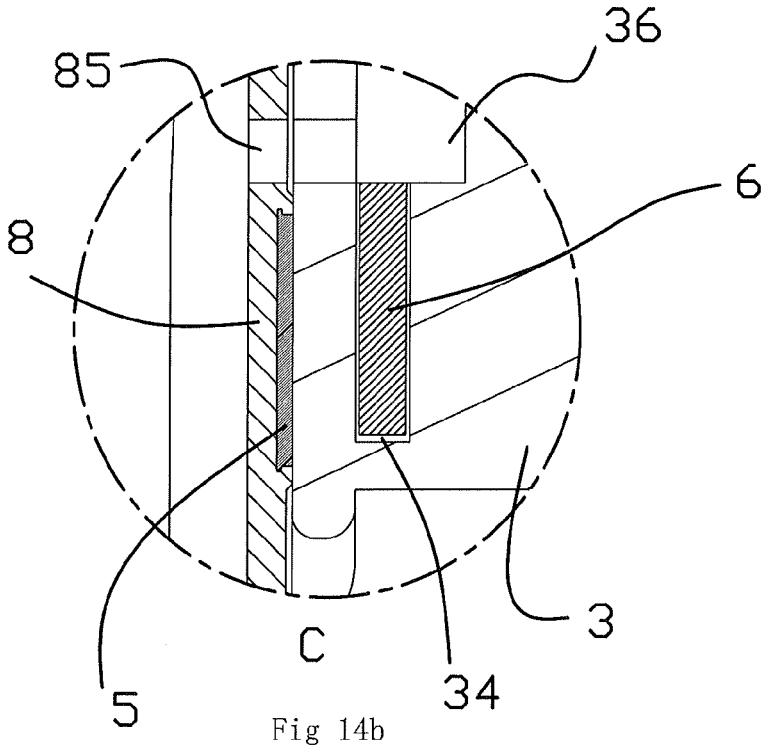

FIG. 13 is a partially perspective view of the container 1, in which the cover 8 is closed. FIGS. 14*a*-14*b* show relative positions of components of the cover device 100 when the cover 8 is closed. As shown in FIG. 14*b*, the cover 8 is in a closed state, and the locking hole 85 is aligned to the locking groove 36. The magnet 6 is received in the groove 34. The center of the metal piece 5 and the center of the magnet 6 are in substantially the same straight line, so that the metal piece 5 and the magnet 6 can effectively attract to each other, thus securely locking the cover 8.

Figure 15A:
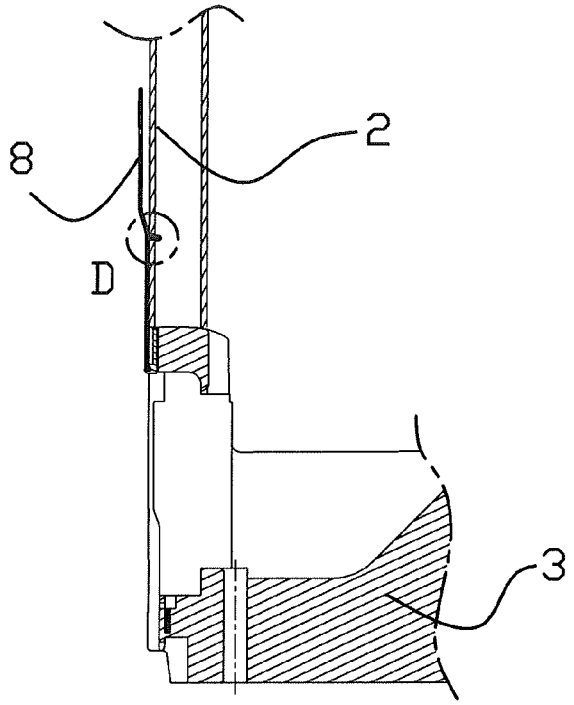
Figure 15B:
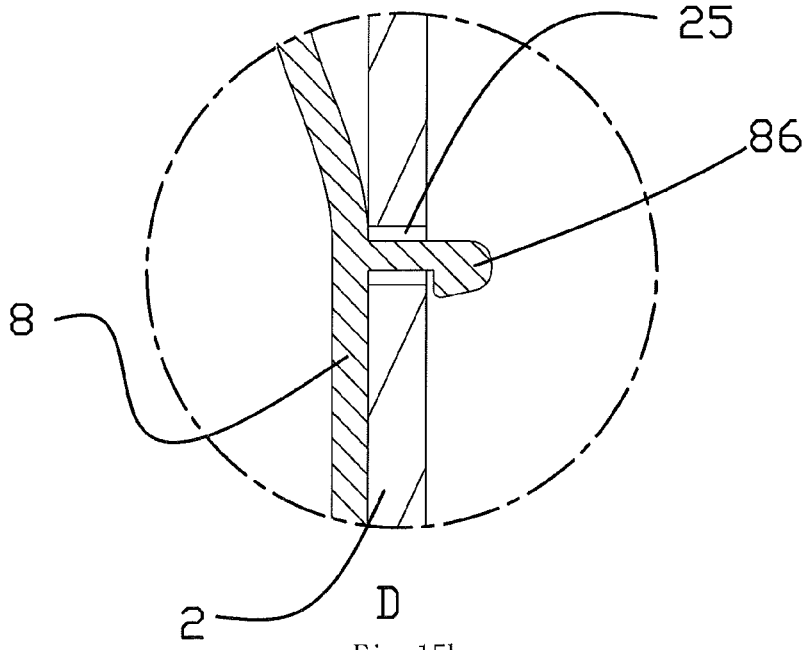

FIGS. 15*a*-15*b* show sectional views of the container when cover 8 of which is opened, for clarity, only the structures associated with the present invention are shown here. As shown in FIGS. 15*a*-15*b*, after door 8 is opened, the cover body 81 can be rotated around the hinge 83 and can be held on the side plate 2 through the engagement of the locking snap 86 on cover 4 with the locking hole 25 on side plate 2.

When it is needed to put down the cover so as to cover the valve mounting channel port, just pull it out forcefully. The cover 8 will be separated from the side plate 2 due to the elastic deformation of the locking snap 86. After the separation of the snap 86 and the snap hole 25, the cover 8 will be flipped downward due to gravity, and cover the valve mounting channel port 32 through the interaction (magnetic attraction) between the metal piece 5 and the magnet 6.

Alternatively, when side plate 2 falls down, the cover will be automatically disengaged from the side plate 2 and flipped downward due to gravity and elasticity, and cover valve mounting channel port 32 through the interaction (magnetic attraction) between metal piece 5 and magnet 6.

Similarly, in this embodiment, the disposable lock 7 shown in FIGS. 7*a*-7*c* or other suitable disposable locks may be used to achieve the thief-evident effect. The disposable lock 7 is connected to the cover 8 and the base 3 in the same manner as that of the first embodiment, which will not be elaborated here. Further, similarly, in this embodiment, preferably, security code can be printed on the disposable lock 7 to obtain improved thief-evident effect.

FIGS. 16-18*b* show the third embodiment of the cover device used to cover the built-in valve mounting channel port of IBC. The embodiment is similar to the second embodiment except that the structure used to keep the cover 4 on the side plate 2 when the cover is opened, thus the same features will not be elaborated herein.

Figure 16:
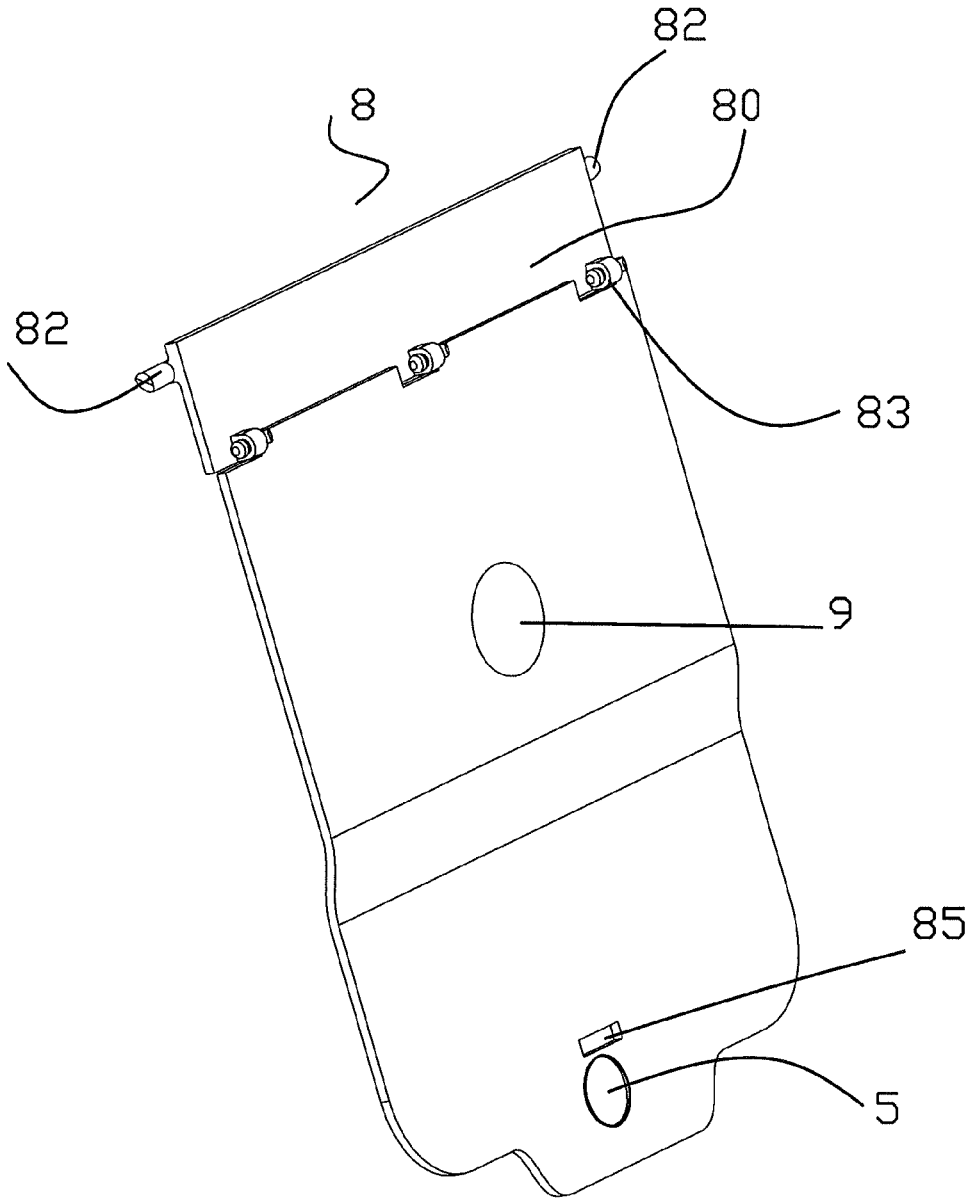
FIG. 16 shows a structural perspective view of the cover of the cover device according to the third embodiment of the present invention.
Figure 17:
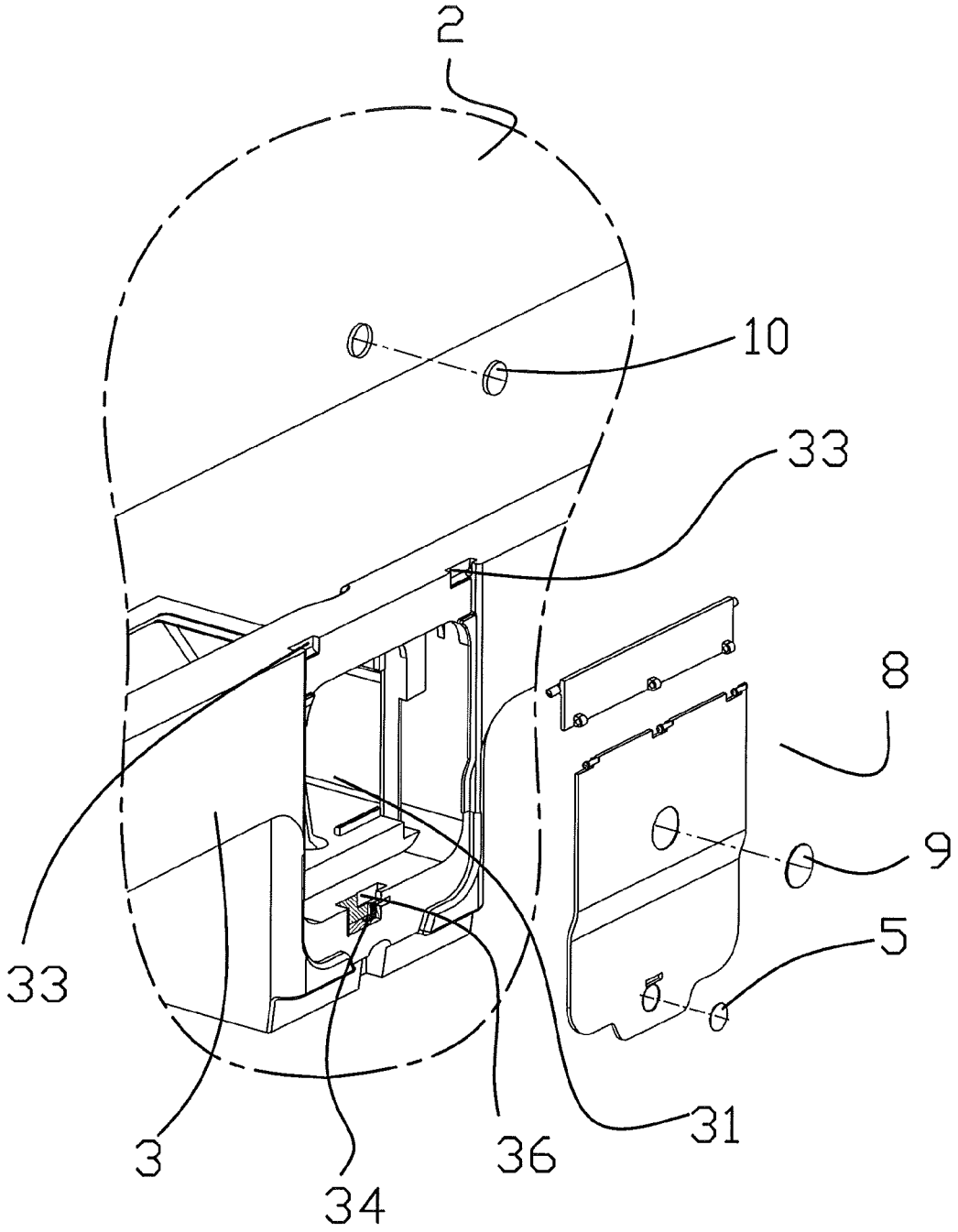
FIG. 17 shows an exploded perspective view of the container provided with the cover device according to the third embodiment of the present invention, for clarity, here is shown only the parts associated with the cover device of the present invention.

In the second embodiment, the structures that keeps the cover 4 on the side plate comprise the snap 86 located on the cover body 81 and the snap hole 25 located on side plate 2. While in this embodiment, as shown in FIGS. 16-17, the structures that keeps the cover 4 on the side plate comprise a metal piece 9 located in the cover body 81 and another magnet 10 located in the side plate 2. The metal piece 9 is positioned at an appropriate place in the cover body 81, and in this embodiment, the metal piece 9 is located substantially at the center of the body 81. The metal piece 9 can be made of metals attractable to magnet, such as iron, cobalt, nickel and other materials. Also, it can be a magnet. Preferably, the metal piece 9 is a magnet.

The magnet 10 may be integrally molded to the side plate at the position corresponding to that of the metal piece 9 when the cover 4 is flipped upward and is substantially parallel to the side plate 2. Alternatively, a groove used to receive the magnet 10 can also be provided at the side plate 2.

Figure 18A:
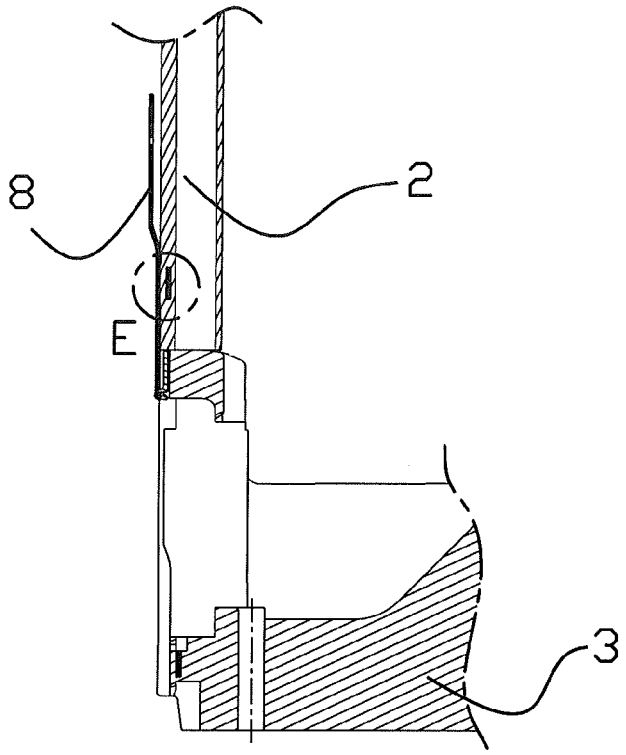
FIGS. 18*a*-18*b* show relative positions of components of the cover device according to the third embodiment of the present invention when the cover is opened.
Figure 18B:
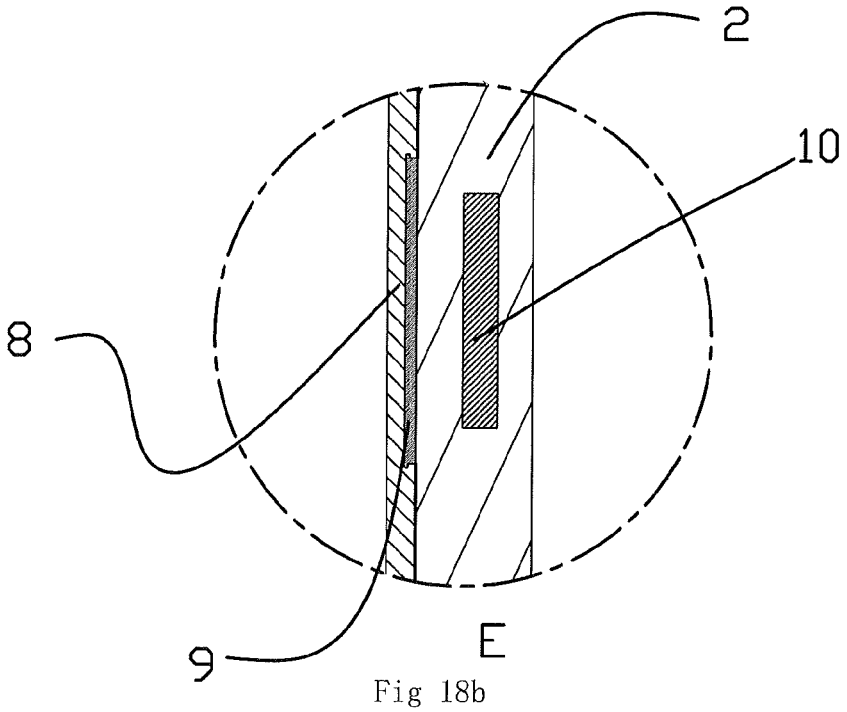

FIGS. 18*a*-18*b* show sectional views of the container, wherein the cover 8 is opened, and for clarity, only the structures associated with the present invention are shown here. After the cover 8 is opened, the cover body 81 can be rotated around the hinge 83 and can eventually be kept on the side plate 2 through the mutual attraction between the metal piece 9 on the cover 8 and the magnet 10 on the side plate 2.

Similarly, in this embodiment, the disposable lock 7 shown in FIGS. 7*a*-7*c* or other suitable disposable locks may be used to achieve the thief-evident effect. The disposable lock 7 is connected to the cover 8 and the base 3 in the same manner as that of the first embodiment, which will not be elaborated here. Further, similarly, in this embodiment, preferably, security code can be printed on the disposable lock 7 to obtain improved thief-evident effect.

It should be noted that in the embodiments described above, the locations of the metal piece and the magnet are interchangeable, i.e., the metal piece is provided at the corresponding position of the container, while the magnet is provided on the cover. Also, magnets can be provided at both sides, and the shapes of the metal piece and the magnet can be determined as desired. In addition, the cover is preferably made of plastic material of better toughness.

The cover device used to cover the built-in valve mounting channel port of IBC has a simple structure and is easy to operate. The shape of the cover device corresponds to that of the channel port of the channel used to receive the built-in valve, and therefore has a good dust-proof effect. Further, the cover device can be reused, thereby saving cost.

Preferred embodiments of the present invention has been described in detail above, while it is to be understood that, after reading the above teachings of the present invention, those skilled in the art may make various modifications or amendments to the present invention. These equivalent forms still fall into the scope limited by appended claims of the present application.

The invention claimed is:

1. An intermediate bulk container (IBC) comprising:

a side plate, a base, and a channel located in said base and used to receive a built-in valve, wherein said IBC further comprises a cover device, said cover device comprises a cover and structures used to detachably connect said cover to said side plate over said channel;

said cover is installable on said base at a position adjacent to said side plate and is rotatable around a rotational axis of said cover, so as to open or cover a channel port of said IBC;

wherein said cover is a plate member comprising a fitting part and a cover body, wherein said rotational axis is located between said fitting part and said cover body so that said cover body is rotatable around said rotational axis;

fitting pins used to assemble said cover to said base are provided at left and right sides of said fitting part respectively, and grooves for engaging with said fitting pins of said cover are provided at an upper edge of said base of said IBC, wherein said fitting pins of said cover are mountable to and removable from said grooves when said side plate is collapsed, and wherein said fitting pins of said cover cannot escape from said grooves when said side plate is erected up; and said structures used to be detachably engaged with said side plate are provided on said cover body, and a mating structure corresponding to said structures on said cover body is provided at said side plate.

2. The IBC according to claim 1, wherein:

said structures on said cover body detachably engaged with said side plate include locking slots located at left and right sides respectively;

said mating structure on said side plate includes grooves and ribs on both sides of said grooves respectively; and said locking slots are engageable with said ribs under elastic deformation so as to keep said cover on said side plate, and said locking slots are disengageable from said ribs so as to disengage said cover from said side plate.

3. The IBC according to claim 1, wherein:

said structures on said cover body detachably engaged with said side plate comprise a locking snap projecting integrally from a surface of said cover body;

said corresponding structures on said side plate are a snap hole on said side plate; and said locking snap is snappable into said snap hole so as to keep said cover on said side plate, and said locking snap is disengageable from said snap hole so that said cover is disengaged from said side plate.

4. The IBC according to claim 1, wherein:

said structures on said cover body detachably engaged with said side plate are a metal piece;

said mating structure on said side plate is a magnet; and said metal piece and said magnet are attractable to or separable from each other so as to respectively keep said cover on said side plate and disengage said cover from said side plate.

5. The IBC according to claim 1, wherein:

a rotating part is provided between said fitting part and said cover body, wherein said fitting part, said rotating part, and said cover body are integrally formed; and a thickness of said rotating part is thinner than that of said fitting part and said cover body, so that said rotating part is used as said rotational axis of said cover and when said cover body is flipped upward, said cover body is rotated around said rotating part.

6. The IBC according to claim 1, wherein said fitting part includes hinge holes, and said cover body includes hinge pins, wherein said hinge holes and said hinge pins constitute hinges so that after said fitting part is assembled to said cover body, when said cover body is flipped upward, said cover body is rotated around said hinges.

7. The IBC according to claim 1, wherein said cover body includes a metal piece at a lower part thereof, and said base includes a magnet, so that said metal piece and said magnet are attractable to or disengageable from each other so as to keep said cover on said base or disengage said cover from said base.

8. An intermediate bulk container (IBC) comprising:

a side plate, a base, and a channel located in said base and used to receive a built-in valve, wherein:

said IBC further comprises a cover device, and said cover device comprises a cover and structures used to detachably connect said cover to said side plate over said channel;

said cover is installable on said base at a position adjacent to said side plate, is rotatable around a rotational axis of said cover, so as to open or cover a channel port of said IBC;

wherein said cover is a plate member comprising a fitting part and a cover body, wherein said rotational axis is located between said fitting part and said cover body so that said cover body is rotatable around said rotational axis;

fitting pins used to assemble said cover to said base are provided at left and right sides of said fitting part respectively, and grooves for engaging with said fitting pins of said cover are provided at an upper edge of said base of said IBC, wherein said fitting pins of said cover are mountable to and removable from said grooves when said side plate is collapsed, and wherein said fitting pins of said cover cannot escape from said grooves when said side plate is erected up; and said structures used to be detachably engaged with said side plate are provided on said cover body, and a mating structure corresponding to said structures on said cover body is provided at said side plate; and said cover includes a lock hole, and said base includes a locking slot, so that said cover is lockable to said base by a disposable lock.

9. The IBC according to claim 8, wherein said cover body includes a metal piece at a lower part thereof, and said base includes a magnet, so that said metal piece and said magnet are attractable to or disengageable from each other so as to keep said cover on said base or disengage said cover from said base.

10. An intermediate bulk container (IBC), comprising:

a side plate, a base, and a channel located in said base and used to receive a built-in valve, wherein:

said IBC further comprises a cover device, and said cover device comprises a cover and structures used to detachably connect said cover to said side plate over said channel; and said cover is installable on said base at a position adjacent to said side plate and is rotatable around a rotational axis of said cover so as to open or cover a channel port;

wherein said cover body includes a metal piece at a lower part thereof, and said base includes a magnet, so that said metal piece and said magnet are attractable to or disengageable from each other so as to keep said cover on said base or disengage said cover from said base, wherein said cover is a plate member comprising a fitting part and a cover body, wherein said rotational axis is located between said fitting part and said cover body so that said cover body is rotatable around said rotational axis;

fitting pins used to assemble said cover to said base are provided at left and right sides of said fitting part respectively, and said structures used to be detachably engaged with said side plate is provided on said cover body, and a mating structure corresponding to said structures on said cover body is provided at said side plate.

11. The IBC according to claim 10, wherein:

said structures on said cover body detachably engaged with said side plate includes locking slots located at left and right sides respectively;

said mating structure on said side plate includes grooves and ribs on both sides of said grooves respectively; and said locking slots are engageable with said ribs under elastic deformation so as to keep said cover on said side plate, and said locking slots are disengageable from said ribs so as to disengage said cover from said side plate.

12. The IBC according to claim 10, wherein said fitting part includes hinge holes, and said cover body includes hinge pins, wherein said hinge holes and said hinge pins constitute hinges so that after said fitting part is assembled to said cover body, when said cover body is flipped upward, said cover body is rotated around said hinges.

* * * * *